United States Patent [19]

Halter et al.

[11] 4,212,711

[45] Jul. 15, 1980

[54] ELECTROCHEMICAL OXIDATION OF ALKYL AROMATIC COMPOUNDS

[75] Inventors: Mark A. Halter, Schaumburg; Thomas P. Malloy, Lake Zurich, both of Ill.

[73] Assignee: UOP Inc., Des Plaines, Ill.

[21] Appl. No.: 52,646

[22] Filed: Jun. 27, 1979

[51] Int. Cl.[2] ..... C25B 3/02

[52] U.S. Cl. ..... 204/78

[58] Field of Search ..... 204/78

[56] References Cited

U.S. PATENT DOCUMENTS

| | | | |
|---|---|---|---|
| 729,502 | 5/1903 | Moest | 204/78 |
| 3,745,180 | 7/1973 | Rennie | 204/78 |

*Primary Examiner*—R. L. Andrews

*Attorney, Agent, or Firm*—James R. Hoatson; Raymond H. Nelson; William H. Page, II

[57] ABSTRACT

Alkyl aromatic compounds may be subjected to an electrochemical oxidation in an appropriate electrochemical cell utilizing a semi-emulsion solution comprising said alkyl aromatic compound in a dilute mineral acid solution containing a salt of a transition metal. The reaction is preferably effected at ambient temperature and atmospheric pressure utilizing an electrical energy which includes a voltage in the range of from about 2 to about 20 volts or a current density in the range of from about 0 to about 1000 miliamps per square centimeter.

13 Claims, No Drawings

ELECTROCHEMICAL OXIDATION OF ALKYL AROMATIC COMPOUNDS

BACKGROUND OF THE INVENTION

Aromatic aldehydes which may be used in a variety of chemical reactions have, in the past, been prepared by various alternate reactions. For example, one method of preparing an aromatic aldehyde has been an air oxidation reaction in an oxygen enriched environment utilizing relatively high temperatures and pressures in combination with a transition metal catalyst such as cupric bromide. Another method of effecting the preparation of aromatic aldehydes is by the chemical oxidation of the substrate using stoichiometric quantities of an oxidizing agent which is obtained by way of known electrochemical methods using concentrated sulfuric or perchloric acid, said reaction being effected at elevated temperatures. Yet another basic synthesis reaction for obtaining aromatic aldehydes is the chemical oxidation of the substrate using stoichiometric quantities of electrochemically generated oxidants such as salts of cobalt, manganese, or chromium in their highest valence state in a strongly acidic media at elevated temperatures. Reduced oxidant is then recycled, purified and electrolytically reoxidized back to its active state.

The inherent drawback in the last named reaction involves the reoxidation and recycling of the oxidant by electrochemical methods. Heretofore all of the methods which have been employed in this area have oxidized the transition metal to its higher valence state prior to combination of the same with the organic substrate in a conventional chemical reactor. In essence, this comprises a two step reaction which requires both an electrochemical reactor and a chemical reactor. In addition, the aforementioned processes have utilized relatively concentrated acids such as from 40 to 70% concentrations of sulfuric acid or perchloric acid thus making the selectivities of these processes for activated alkyl aromatic systems less than desirable. The undesirability of these processes results from the tendency of the alkyl aromatic systems towards sulfonation or by-product formation.

As will hereinafter be set forth in greater detail, it has now been discovered that the oxidation of an alkyl aromatic compound may be effected by utilizing a process in which the alkyl aromatic compound is oxidized in the presence of a certain medium.

This invention relates to a process for the electrochemical oxidation of an alkyl aromatic compound. More specifically, the invention is concerned with a process for obtaining improved yields of desired compounds during the aforesaid process.

Aromatic aldehydes will find a wide variety of uses in the chemical field. For example, anisaldehyde, and especially the para isomer will find a use as a component in perfumes, colognes, scents, etc., and as an intermediate for pharmaceutical compounds such as antihistamines. Likewise, 3-ethoxy-4-hydroxybenzaldehyde which is also known as ethyl vanillin is used in flavors as a replacement or fortifier of vanillin. Another aldehyde which finds an important use in the chemical industry is p-chlorobenzaldehyde which is used as an intermediate in the preparation of triphenyl methane and related dyes as well as for the synthesis of orgaic chemicals such as pharmaceuticals and medicinals.

It is therefore an object of this invention to provide a process for the electrochemical oxidation of alkyl aromatic compounds to form desirable oxidative products.

A further object of this invention is to provide a method for obtaining improved yields of desired oxidation products such as aldehydes with a concommitant lesser amount of undesired side products being formed therewith.

In one aspect an embodiment of this invention resides in a process for the electrochemical oxidation of an alkyl aromatic compound, the improvement which comprises effecting said electrochemical oxidation in an electrochemical cell in the presence of a semi-emulsion solution of said alkyl aromatic compound in a dilute mineral acid solution containing a salt of a transition metal and recovering the resultant aldehyde.

A specific embodiment of this invention is found in a process for the electrochemical oxidation of p-methoxytoluene, the improvement which comprises effecting said electrochemical oxidation in an electrochemical cell at a temperature in the range of from about ambient to about 80° C. and atmospheric pressure in the presence of a semi-emulsion solution of p-methoxytoluene in a dilute sulfuric acid medium containing manganous sulfate, utilizing electrical energy which includes a voltage in the range of from about 2 to about 20 volts or a current density in the range of from about 0 to about 1000 milliamps/cm$^2$, and recovering the resultant anisaldehyde.

Other objects and embodiments will be found in the following further detailed description of the present invention.

As hereinbefore set forth the present invention is concerned with a one-step indirect electrochemical oxidation of alkyl aromatic to form the corresponding aldehydes. Although, as hereinbefore set forth, prior art methods have utilized a two-step process to effect the same reaction in which the transition metal is oxidized to its higher valency state prior to combination of the same with the organic substrate in a conventional chemical reactor followed by the electrochemical oxidation, it has now been discovered that the desired oxidation reaction may be effected in a one-step process. This one-step process was unexpected in view of the fact that previous attempts to attain one-step electrolysis have been unsuccessful due to various problems such as electrode fouling and/or electrolyte, contamination, neither of which have been found to occur in the present process. The oxidation of the starting material in an electrochemical reaction is effected by utilizing a semi-emulsion solution of the alkyl aromatic compound which acts as a substrate in a dilute mineral acid solution which contains a salt of a transition metal in its lowest positive valence state, said salt being capable of serving as an indirect oxidant. The reaction may be effected in a divided electrolytic cell using suitably chosen electrodes and an environmentally stable anion exchange membrane or, if so desired, it may also be effected in a standard electrolytic cell which is not divided.

By utilizing the process of the present invention, it is possible to effect the desired reaction in a one-step process requiring only product separation with no need for concurrent electrolyte purification, the process may be effected utilizing a significantly less corrosive and industrially feasible medium with the concurrent advantages of using less energy due to the fact that the reaction may be effected at ambient temperature if so desired. This will also result in lower overall processing costs as well as low by-product formation.

The alkyl aromatic compounds which are used as starting materials for the electrochemical oxidation process of this invention and which possess an activating substituent on the ring thereof will include those compounds having the generic formula

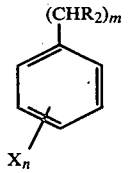

in which R is hydrogen or methyl radicals, X is independently selected from the group consisting of alkyl, alkoxy, hydroxy, primary amine, secondary amine, tertiary amine, benzyl and amide radicals, m is an integer of from 1 to about 4 and n is a radical of from 1 to 5 such as o-hydroxytoluene, m-hydroxytoluene, p-hydroxytoluene, o-methoxytoluene, m-methoxytoluene, p-methoxytoluene, o-ethoxytoluene, m-ethoxytoluene, p-ethoxytoluene, o-propoxytoluene, m-propoxytoluene, p-propoxytoluene, o-butoxytoluene, m-butoxytoluene, p-butoxytoluene, o-xylene, m-xylene, p-xylene, 1,2,3-trimethylbenzene, 1,3,5-trimethylbenzene, 1,2,4-trimethylbenzene, 1,2,3,4-tetramethylbenzene, pentamethylbenzene, o-ethyltoluene, m-ethyltoluene, p-ethyltoluene, o-n-propyltoluene, m-n-propyltoluene, p-n-propyltoluene, o-isopropyltoluene, m-isopropyltoluene, p-isopropyltoluene, o-n-butyltoluene, m-n-butyltoluene, p-butyltoluene, o-t-butyltoluene, m-t-butyltoluene, p-t-butyltoluene, o-hydroxyethylbenzene, m-hydroxyethylbenzene, p-hydroxyethylbenzene, o-methoxyethylbenzene, m-methoxyethylbenzene, p-methoxyethylbenzene, o-ethoxyethylbenzene, m-ethoxyethylbenzene, p-ethoxyethylbenzene, o-propoxyethylbenzene, m-propoxyethylbenzene, p-propoxyethylbenzene, o-butoxyethylbenzene, m-butoxyethylbenzene, p-butoxyethylbenzene, 1,2-diethylbenzene, 1,3-diethylbenzene, 1,4-diethylbenzene, 2-propylethylbenzene, 3-propylethylbenzene, 4-propylethylbenzene, 2-t-butylethylbenzene, 3-t-butylethylbenzene, 4-t-butylethylbenzene, 2-hydroxymethylnaphthalene, 3-hydroxymethylnaphthalene, 4-hydroxymethylnaphthalene, 2-methoxymethyl-naphthalene, 3-methoxymethylnaphthalene, 4-methoxymethylnaphthalene, 2-ethoxymethylnaphthalene, 3-ethoxymethylnaphthalene, 4-ethoxymethylnaphthalene, 2-propoxymethylnaphthalene, 3-propoxymethylnaphthalene, 4-propoxymethylnaphthalene, 1,2-dimethylnaphthalene, 1,3-dimethylnaphthalene, 1,4-dimethylnaphthalene, 2-ethylmethylnaphthalene, 3-ethylmethylnaphthalene, 4-ethylmethylnaphthalene, 5-ethylmethylnaphthalene, o-toluidine, m-toluidine, p-toluidine, o-ethylaniline, m-ethylaniline, p-ethylaniline, o-isopropylaniline, m-isopropylaniline, p-isopropylaniline, o-n-butylaniline, m-n-butylaniline, p-n-butylaniline, o-methyl-N-methylaniline, m-methyl-N-methylaniline, p-methyl-N-methylaniline, o-methyl-N,N-dimethylaniline, m-methyl-N,N-dimethylaniline, p-methyl-N,N-dimethylaniline, o-methyl-N,N-diethylaniline, m-methyl-N,N-diethylaniline, p-methyl-N,N-diethylaniline, o-benzyltoluene, m-benzyltoluene, p-benzyltoluene, o-benzylethylbenzene, m-benzylethylbenzene, p-benzylethylbenzene, etc. It is to be understood that the aforementioned alkyl substituted aromatic compounds which contain an activated substituent on the ring thereof are only representatives of the class of compounds which may be employed, and that the present invention is not necessarily limited thereto.

The electrochemical oxidation of the aforementioned alkyl aromatic compound is accomplished by utilizing a reaction medium comprising a semi-emulsion solution of a mineral acid containing a salt of a transition metal in its lower valence state. The mineral acids which are employed will comprise hydrochloric acid, perchloric acid, boric acid, sulfuric acid, phosphoric acid, polyphosphoric acid, pyrophosphoric acid, etc., the amount of mineral acid being present in the aqueous solution in a range of from about 2 to about 55%. The use of these relatively dilute solutions of mineral acids is in contrast to the prior art methods which have usually employed acids such as sulfuric acid or perchloric acid in concentrations up to about 70%.

The semi-emulsion solution as hereinbefore set forth will also contain a compound capable of acting as an indirect oxidant. These compounds will comprise salts of transition metals and particularly salts of cobalt, cerium, chromium, manganese, iron, lead and silver in which the metal is present in its lowest valence state. Some representative examples of these salts of transition metals will include cobaltous formate, cobaltous acetate, cobaltous propionate, cobaltous butyrate, cobaltous valerate, cobaltous hexanoate, cobaltous acetylacetonate, cobaltous sulfate, cobaltous chloride, cobaltous nitrate, cobaltous bromide, cobaltous iodide, cobaltous fluoride, cerous formate, cerous acetate, cerous propionate, cerous butyrate, cerous valerate, cerous hexanoate, cerous acetylacetonate, cerous sulfate, cerous chloride, cerous nitrate, cerous bromide, cerous iodide, cerous fluoride, chromous formate, chromous acetate, chromous propionate, chromous butyrate, chromous valerate, chromous hexanoate, chromous acetylacetonate, chromous sulfate, chromous chloride, chromous nitrate, chromous bromide, chromous iodide, chromous fluoride, manganous formate, manganous acetate, manganous propionate, manganous butyrate, manganous valerate, manganous hexanoate, manganous acetylacetonate, manganous sulfate, manganous chloride, manganous nitrate, manganous bromide, manganous iodide, manganous fluoride, as well as the corresponding iron, lead and silver salts in which the metal is present in its lowest valence state.

The electrochemical cell in which the electrochemical oxidation of the alkyl aromatic compound is effected may be of any variety which is well known in the art. The electrodes which are employed in the cell may be formed of any conductive material such as a carbon anode and a stainless steel cathode, a ruthenized titanium dioxide-based anode, and a copper cathode, etc., although it is also contemplated that other conductive materials may also be utilized. The oxidation reaction is effected utilizing an electrical energy which includes a voltage within the range of from about 2 to about 20 volts and/or a current density in the range of from about 0 to about 1000 milliamps/cm$^2$. In the preferred embodiment of the invention, the reaction is effected in a divided electrolytic cell using an environmentally stable anion exchange membrane. It is also contemplated within the scope of this invention that the electrochemical cell which is utilized to effect the electrochemical oxidation of the present invention may also comprise an undivided electrolytic cell containing suitable electrodes such as platinum, lead, etc. When utilizing a divided electrolytic cell the anolyte solution will comprise the semi-emulsion solution hereinbefore discussed while the catholyte solution will comprise an aqueous acidic solution containing a buffer salt. In the preferred embodiment of the invention, the acid in the catholyte will be the same as that used in the anolyte solution and the buffer salt will preferably comprise an alkali or alkaline earth metal salt of the acid.

The process of this invention may be effected in any suitable manner and may comprise either a batch or continuous type of operation. When a batch type of operation is employed, a semi-emulsion solution which will include the aqueous dilute mineral acid and the salt of a transition metal which serves as an indirect oxidant is placed in a divided electrolytic cell as the anolyte solution. The catholyte solution of the type hereinbefore set forth is placed in the other portion of the cell, each section of said cell containing a suitably chosen electrode. The alkyl aromatic compound is then added to the anolyte and after the desired operating temperature has been attained the cell is then subjected to an electrical energy within the range hereinbefore set forth for a predetermined period of time which may range from about 0.5 up to about 10 hours or more in duration. Upon completion of the desired residence time, the mixture is withdrawn from the cell and subjected to conventional means of separation which may include decantation, washing, drying, fractional distillation, etc., whereby the desired product comprising only an aldehyde may be separated from unreacted starting materials and recovered.

It is also contemplated within the scope of this invention that electrochemical oxidation of the alkyl aromatic compound may be effected in a continuous manner of operation. When such a type of operation is used, the aforementioned components of the reaction mixture are continuously charged to an electrochemical cell as the anolyte solution, said cell being maintained at the proper operating conditions of temperature and pressure, the preferred conditions including ambient temperature and atmospheric pressure. After cycling through the cell and being subjected to an electrical change for a predetermined period of time, the effluent is continuously withdrawn and subjected to conventional means of separation similar in nature to those hereinbefore set forth whereby the desired product comprising an aldehyde is recovered, while any unreacted alkyl aromatic compound as well as other components of the emulsion system are recovered.

The following examples are given to illustrate the process of this invention. However, it is to be understood that these examples are given merely for purposes of illustration and that the present invention is not necessarily limited thereto.

EXAMPLE I

In this example a divided electrochemical cell provided with a lead oxide anode and cathode and an anion exchange membrane sold under the tradename IONAC 3475 was used. The anolyte was prepared by admixing 25 grams of sulfuric acid with 250 grams of water and thereafter adding 100 grams of manganous sulfate. The catholyte was prepared by adding 25 grams of sulfuric acid to 250 grams of water and thereafter adding 30 grams of sodium sulfate. The anolyte solution and catholyte solution were added to the respective reservoirs and thereafter 50 grams of p-methoxytoluene was slowly added to the anolyte solution. The electrical energy which was used consisted of an E applied voltage ranging from 4.0 to 6.0 volts along with about 2.0 amps while maintaining the current density at a rate of about 80 milliamps/cm$^2$. In addition, the reaction was run at ambient temperature and atmospheric pressure. The solution was passed through the cell and condenser and back to the cell by use of a pump. The reaction was run for a period of 3.33 hours at the end of which time a gas liquid chromatographic analysis disclosed a yield of 46% anisaldehyde with a selectivity to the aldehyde of greater than 50%, current efficiencies of 85–100% being observed.

EXAMPLE II

In this example an undivided cell was used, said cell being provided with a platinum anode and a lead cathode. A solution of 250 grams of water, 10 grams of sulfuric acid and 50 grams of manganous sulfate was placed in the cell and 50 grams of p-methoxytoluene slowly added thereto. The electrical energy which was used consisted of an E applied voltage of 5.5 volts along with about 4.0 amps while maintaining the current density at a rate of about 80 milliamps/cm$^2$. The reaction was effected for a period of about 3.5 hours while maintaining the cell at ambient temperature and atmospheric pressure. A work-up of the results disclosed that there had been a 47.1% yield of anisaldehyde with a 50.5% selectivity to said aldehyde, a current efficiency of 93.3% being observed.

When the above experiment was repeated using 17.5 grams of sulfuric acid in the electrolyte, there was observed a current yield of 44.0% with a 51.8% selectivity to anisaldehyde. In addition, the current efficiency was 84.9%. Again, when the experiment was repeated using 32 grams of sulfuric acid, the oxidation of p-methoxytoluene resulted in a current yield of 54.1%, a 54.1% selectivity to the aldehyde and a 100% current efficiency.

EXAMPLE III

In a manner similar to that set forth in the above example, 50 grams of p-ethoxytoluene may be subjected to an electrochemical oxidation in the presence of a mixture comprising 250 grams of water, 25 grams of perchloric acid and 50 grams of cerous chloride. The reaction may be effected using an E applied voltage of about 5.5 volts and 4.0 amps while maintaining the current density of about 80 milliamps/cm$^2$. The desired product comprising p-ethoxybenzaldehyde may be recovered at the end of a period of about 4 hours by conventional means.

EXAMPLE IV

In this example 613 grams of concentrated sulfuric acid and 500 grams of water were added to a flask which was equipped with a reflux condenser. After the sulfuric acid was brought to the temperature of 70° C., 16.58 grams of manganous sulfate and 14.54 grams of p-t-butyltoluene were quickly added. The contents were stirred vigorously and passed to a Teflon coated electrolytic cell which was composed of two parallel circular electrodes, the anode being platinum and the cathode being lead, which were spaced at a distance of 6 mm from each other. Upon equilibrating the temperature of the electrolyte a current of 3.2 volts and 0.75 amps was turned on. The reaction was allowed to proceed for a period of 3.5 hours at a flow rate of 180 ml/min. Upon completion of the reaction time, the organic and aqueous phases were separated in a separatory funnel, the extract was dried and the main organic phase was mixed with n-octane and analyzed by means of gas liquid chromatography. This chromatography determined that there had been a 29% conversion with a 46% selectivity to p-t-butylbenzaldehyde, in addition it was determined that there had been a 54% current yield at a current efficiency of 117%.

When the experiment was repeated utilizing similar conditions including a current density of 35 milliamps/cm$^2$ for a period of 3.5 hours, the desired product comprising p-t-butylbenzaldehyde was recovered at a current yield of 45%, there having been a 40% conversion of the p-t-butyltoluene with a 28% selectivity.

We claim as our invention:

1. In a process for the electrochemical oxidation of an alkyl aromatic compound, the improvement which comprises effecting said electrochemical oxidation in an electrochemical cell in the presence of a semiemulsion solution of said alkyl aromatic compound in a dilute mineral acid solution containing a salt of a transition metal and recovering the resultant aldehyde.

2. The process as set forth in claim 1 being effected at a temperature in the range of from about ambient to about 80° C. and atmospheric pressure.

3. The process as set forth in claim 1 in which said electrochemical oxidation is effected utilizing electrical energy which includes a voltage in the range of from about 2 to about 20 volts or a current density in the range of from about 0 to about 1000 milliamps per square centimeter.

4. The process as set forth in claim 1 in which said salt of a transition metal is manganous sulfate.

5. The process as set forth in claim 1 in which said salt of a transition metal is manganous phosphate.

6. The process as set forth in claim 1 in which said salt of a transition metal is cobaltous sulfate.

7. The process as set forth in claim 1 in which said salt of a transition metal is cerous chloride.

8. The process as set forth in claim 1 in which said mineral acid is sulfuric acid.

9. The process as set forth in claim 1 in which said mineral acid is perchloric acid.

10. The process as set forth in claim 1 in which said mineral acid is hydrochloric acid.

11. The process as set forth in claim 1 in which said alkyl aromatic compound is p-methoxytoluene and said aldehyde is anisaldehyde.

12. The process as set forth in claim 1 in which said alkyl aromatic compound is p-ethoxytoluene and said aldehyde is p-ethoxybenzaldehyde.

13. The process as set forth in claim 1 in which said aromatic compound is p-t-butyltoluene and said aldehyde is p-t-butylbenzaldehyde.

* * * * *